United States Patent [19]

Bartels et al.

[11] Patent Number: 4,787,554

[45] Date of Patent: Nov. 29, 1988

[54] FIRING RATE CONTROL SYSTEM FOR A FUEL BURNER

[75] Inventors: James I. Bartels, Hudson, Wis.; Kenneth B. Kidder, Coon Rapids, Minn.

[73] Assignee: Honeywell Inc., Minneapolis, Minn.

[21] Appl. No.: 151,056

[22] Filed: Feb. 1, 1988

[51] Int. Cl.[4] ..... F23N 1/00; G06F 15/20

[52] U.S. Cl. ..... 236/26 R; 236/78 D; 122/448 R

[58] Field of Search ..... 236/26 R, 26 A, 26 B, 236/26 C, 26 D, 26 E, 26 F, 15 C, 15 BR, 15 BF, 15 BG, 20 R, 22, 32, 33, 1 EB, 21 R, 21 B; 122/448 R; 237/8 R, 8 A, 8 B, 65; 364/557, 558, 505

[56] References Cited

U.S. PATENT DOCUMENTS 4,373,663 2/1983 Hammer ..... 236/15 R
4,510,576 4/1985 MacArther et al. ..... 364/557 X

*Primary Examiner*—Harry B. Tanner
*Attorney, Agent, or Firm*—Alfred N. Feldman

[57] ABSTRACT

A boiler control system utilizing a microcomputer, a memory, and a firing rate control scheme provides a boiler with a more responsive control arrangement. This improved response is accomplished by the firing rate control converting the desired pressure setpoint to a computed temperature, and then establishing a computed pressure band for control of the boiler.

6 Claims, 2 Drawing Sheets

$$\text{CALCULATION "A"} \quad TSET = \left[\frac{-8523.83}{LN(SETPOINT + 14.7) - 15.427}\right] - 459.67$$

$$\text{CALCULATION "B"} \quad PBAND' = 2(SETPOINT - e^{X} + 14.7)$$

$$\text{WHERE } X = -8523.83/(TSET - \tfrac{1}{2}TBAND + 459.67) + 15.4267$$

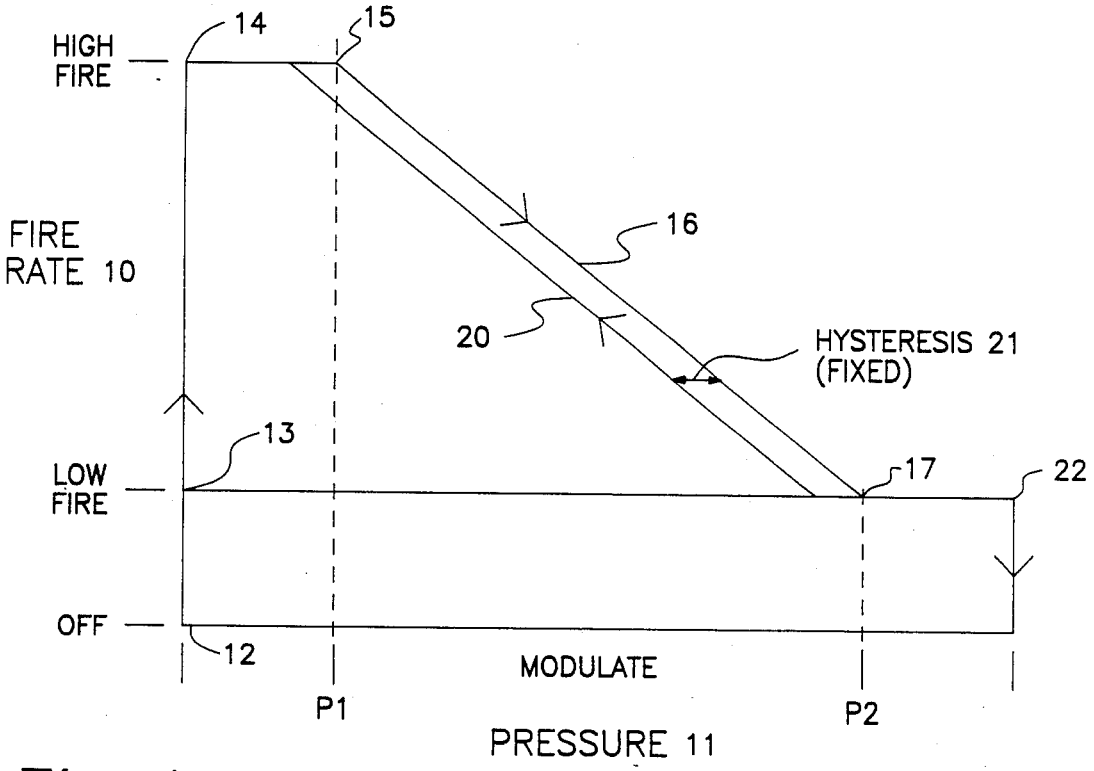
*Fig. 1* *(PRIOR ART)*
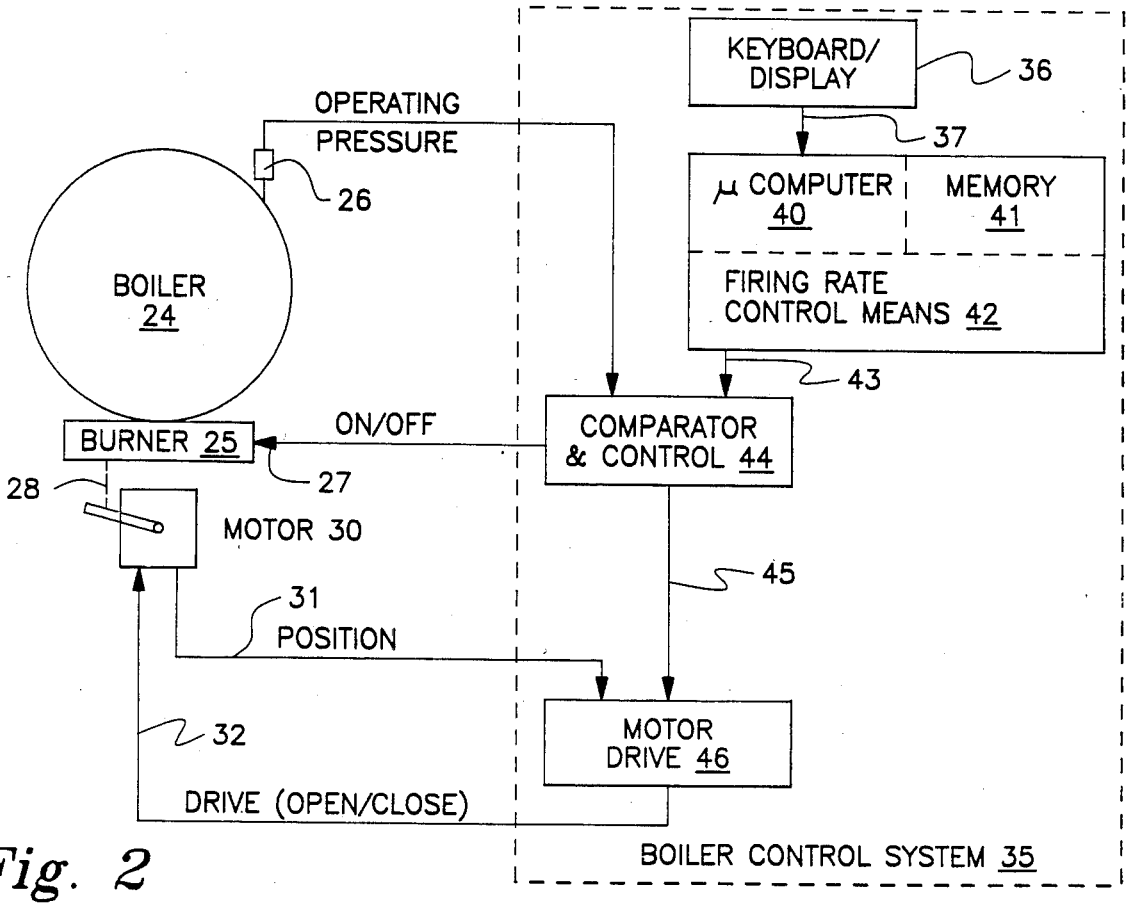
*Fig. 2*

$$\text{CALCULATION "A"} \quad TSET = \left[\frac{-8523.83}{LN(SETPOINT + 14.7) - 15.427}\right] - 459.67$$

$$\text{CALCULATION "B"} \quad PBAND' = 2(SETPOINT - e^{X} + 14.7)$$

$$\text{WHERE } X = -8523.83/(TSET - \tfrac{1}{2}TBAND + 459.67) + 15.4267$$

FIRING RATE CONTROL SYSTEM FOR A FUEL BURNER

BACKGROUND OF THE INVENTION

The control of pressure or temperature in a boiler is typically accomplished by modulation of fuel valves and air dampers so that the energy input matches the energy output. This is normally done by monitoring the pressure within the boiler, and adjusting a modulating type motor to maintain a proper balance by regulating the valves and dampers. These type of controls normally are proportional controls. The pressure is maintained around a desired pressure or setpoint with a fixed range or deviation that is typically referred to as a bandwidth.

A typical boiler control utilizes an off state, a low fire state, a high fire state, and a modulation state between the low fire state and the high fire state. This type of modulation causes a pressure responsive device to make or break over an appropriate range to control the pressure within the boiler.

A variable control bandwidth over which the modulation occurs is achieved through mechanical adjustments. This type of control has a fixed hysteresis due to the mechanical "slop" in the system. The system is adjusted for optimum control which is typically defined as the smallest bandwidth that can be maintained without causing the control motor for the valves and dampers to be unstable or oscillate excessively. The minimum bandwidth to achieve this depends on the load type (that is the rate of change of demand) and the ability of the boiler to respond to that change. The boiler reaction time depends on the motor speed, a function referred to in the trade as a turn down ratio, and the thermal mass of the boiler. The thermal mass is defined as the amount of water in the boiler divided by the burner size in horsepower.

Different types of boilers have different types of thermal masses. These different thermal masses must be taken into account in any sophisticated control system. The different types of thermal masses can be selected from four general classes of boilers. These classes are a steam boiler with a fire tube, a steam boiler with water tubes, a hot water boiler with fire tubes, and a hot water boiler with water tubes. Each one of these four types has a different thermal mass characteristic and that characteristic must be considered in the overall control of the burner for that boiler.

In many cases optimum control is not required. Minimizing modulation, that is motor repositions, may be more important in a particular installation than the desire for an extremely tight control. The type of load response desired and the selection of the thermal mass requires in a conventional system a rather sophisticated evaluation of the system so that the bandwidth and other parameters can be properly selected to match the boiler with the load being serviced.

SUMMARY OF THE INVENTION

A boiler control system is disclosed that utilizes a microcomputer and its associated equipment for control of a burner for a boiler. The microcomputer, its memory, a keyboard and display unit associated with the microcomputer as an input and output means, and a firing rate control means allows for a sophisticated control of a burner. The ability of a microcomputer based system allows for a type of control not previously available.

In the presently disclosed system, the control bandwidth for the boiler is calculated in terms of temperature differential rather than as a pressure difference. The calculation is accomplished from the sensed pressure and known thermal data. The temperature bandwidth that is calculated is much more representative of energy in the boiler than a pressure bandwidth. By controlling to a temperature bandwidth, control stabilization remains consistent regardless of the control setpoint. This is not true if a bandwidth is specified in terms of a pressure band.

The implementation is accomplished by initially entering in a setpoint in pressure, but converting that by a calculation to a temperature setpoint. An empirically established temperature differential is then applied about the calculated temperature setpoint to yield a high and low operating temperature. Because the sensing means and general system operating mode is in terms of pressure, the operating high and low temperatures are converted to their equivalent pressures. This provides a pressure bandwidth of constant energy regardless of the operating setpoint. This is far more consistent than relying on a pressure defined bandwidth.

The present invention is further refined by allowing the pressure bandwidth to be modified as a function of the thermal mass of the type of boiler that is being controlled. In the presently disclosed novel system, the microcomputer can be programmed to take into account the type of thermal mass being controlled to further improve the operation of the system.

After the microcomputer computes the pressure band based on the temperature calculation and the thermal mass, the pressure band is compared in a conventional comparator to the actual pressure in the boiler. The comparator then is in a position to properly operate the burner in its off-on mode, as well as to provide a driving signal to a modulating type of motor to provide the necessary modulation between low fire and high fire positions.

In accordance with the present invention there is provided a boiler control system having a firing rate control function, including: microcomputer means including memory means, and further including input-output means; said input-output means connected to said microcomputer means and said memory means to provide said microcomputer means and said memory means with a plurality of control parameters for a fuel burner and a boiler which are adapted to be controlled by said boiler control system; firing rate control means connected to said microcomputer means and said memory means with said firing rate control means establishing a pressure control band which is a function of a selected setpoint control pressure and a selected temperature band; said firing rate control means converting said setpoint control pressure into a temperature setpoint; said firing rate control means further converting said selected temperature band and said temperature setpoint into a pressure control band; means to measure a pressure in said boiler; comparator means responsive to said pressure control band and a said measured pressure from said boiler to which said system is adapted to be connected; and said comparator means having output means connected to said fuel burner for said boiler to control said fuel burner to in turn control said pressure in said boiler.

BRIEF DESCRIPTION OF THE DRAWINGS

FIG. 1 is a graph of a prior art pressure based system;

FIG. 2 is a block diagram of the novel control system and a boiler to which it is adapted, and;

DESCRIPTION OF THE PREFERRED EMBODIMENT

Figure 3:
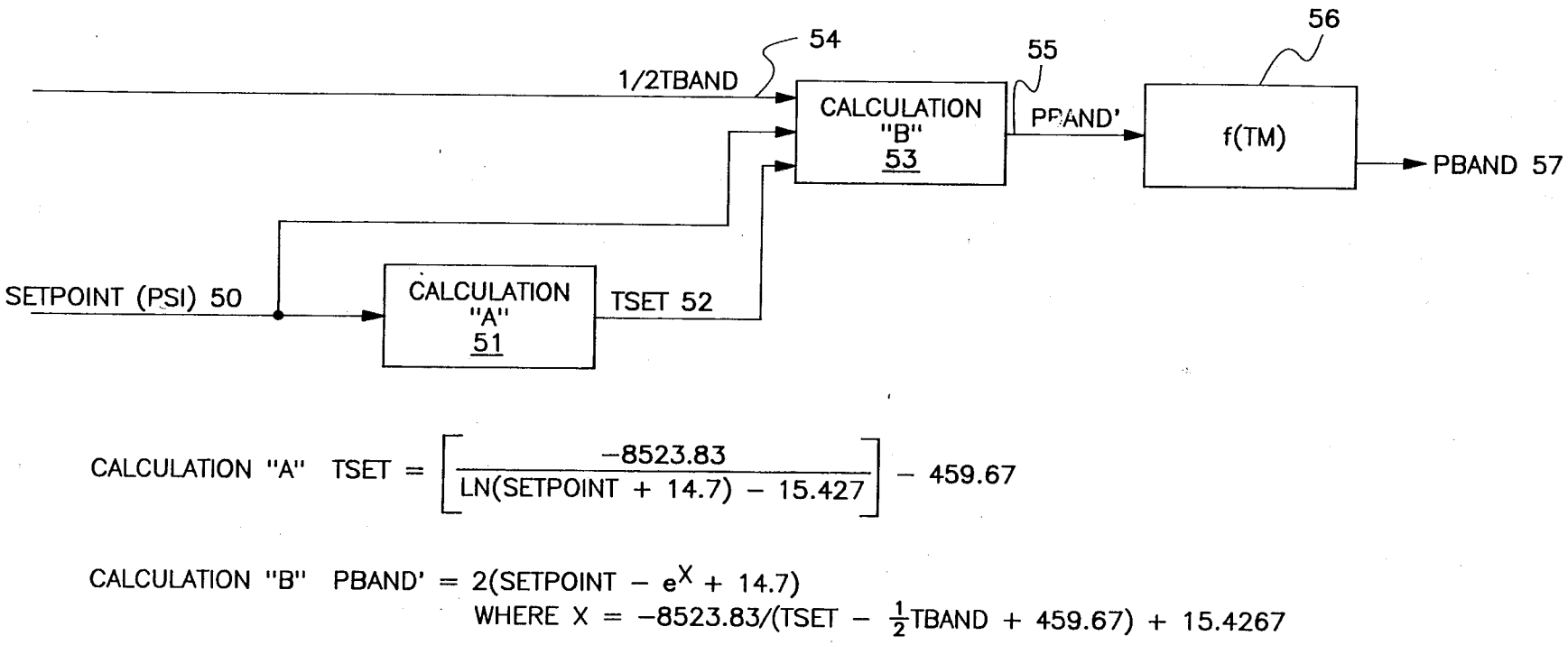
FIG. 3 is a flow chart of the operation of the novel portion of the system.

FIG. 1 is a disclosure of a conventional or prior art control loop. This control loop utilizes mechanical or electromechanical components, including a pressure responsive switch, an electrically operated modulating motor, dampers, etc., in a burner control system for a boiler. FIG. 1 is a plot of the firing rate 10 of a burner for a boiler plotted against the pressure 11 within the boiler. When the burner is activated at 12, the burner operates at high fire 14. As pressure builds up in the boiler at 15, you reach a pressure point P1 that is the beginning of a modulating range. The pressure then varies at 16 depending on the position of the fuel valve and air dampers until a point 17 is reached which is the end of the modulation range at P2. The modulation range between P1 and P2 is typically referred to as the differential or bandwidth for the device. The modulation within this range varies between the curve 16 and a curve 20 because of the natural hysteresis of the mechanical and electromechanical components. The fixed hysteresis 21 is determined by the components in the system and is not variable. When the load on the boiler drops sufficiently, the pressure in the boiler reaches a break point 22 and the system turns off the burner and waits for the next cycle.

This type of system has been used extensively in the past and relies on a control which sets in a pressure at the boiler as its operating point. As can be seen, the pressure in the boiler varies substantially with its operation, and it has been found that a control of this type is less precise than a control which is related to the temperature of the steam or water in the boiler. The temperature in the steam or water has not been used as a control criteria in the past because of the limitations of the mechanical and electromechanical types of control systems.

The present invention utilizes a system of temperature control as an intermediate step in the operation of a burner and boiler. The present invention is implemented with many components traditionally used on a burner and boiler, but under the direct control of a microcomputer based boiler control system or flame safeguard sequencer.

In FIG. 2 a block diagram of a complete system is provided. The boiler 24 that is to be operated is schematically shown. A burner 25 for that boiler is provided and the boiler has a pressure measuring probe or element 26. The burner 25 has all of the conventional valves and dampers an is operated in an on-off manner at 27, and a modulating linkage 28 by a modulating motor 30. The modulating motor 30 has a positional feedback output signal on conductor 31, and receives its energizing or control signal on conductor 32. The conductors 31 and 32, as well as the operating pressure as sensed at sensor 26 and the on-off signal 27, are related to a boiler control system disclosed at 35. The boiler control system 35 includes a keyboard/display means 36 that forms an input-output means for a boiler control system 35. The keyboard/display means 36 typically has the necessary keyboard for inputting data, and a liquid crystal display for outputting data and operating status.

The keyboard/display means or input-output means 36 is connected at 37 to a microcomputer means 40 which includes all of the necessary operating hardware and software including a memory means 41 and a firing rate control means 42. The internal functioning of the firing rate control means 42 will be described in connection with a flow chart of FIG. 3. At this point it is sufficient to understand that the microcomputer means 40, memory 41, and firing rate control means 42 provides an output signal 43 in the form of a pressure bandwidth (PBAND) that is a computed function of a setpoint pressure in pounds per square inch (SETPOINT). While the SETPOINT is entered as a specific pressure at the keyboard/display means 36, the output on conductor 43 is a computed value that is accomplished by the microcomputer means 40, memory 41, and the firing rate control means 42. The pressure band PBAND at 43 is compared in a comparator and control 44. The comparator and control 44 compares the desired pressure operating band, as exemplified by PBAND, against the operating pressure from the sensor 26 and provides two output signals. The first output signal is the signal at 27 which is an on-off signal for the start-stop of the burner 25, and a further signal 45 to the motor drive 46 which in turn operates by way of the conductor 32, the motor 30. The feedback signal on conductor 31 provides closed loop control in a conventional manner.

In the system disclosed in FIG. 2 an operating pressure is set into the input-output means 36. The comparator and control 44 actually operates the system under the control of the firing rate control means 42 against a pressure range that has been computed using the temperature within the system as opposed to operating directly against a pressure setpoint as entered in the input-output means 36.

As has been indicated in the Summary of the Invention, a control bandwidth PBAND is calculated in terms of temperature rather than pressure. This calculation is made from the pressure setpoint entered at 36 and the use of a known thermal relationship, and an empirically relationship for the bandwidth of a temperature range to be used. The temperature bandwidth is much more representative of the energy in the boiler, and by controlling against the temperature bandwidth a more consistent control is provided. This temperature control is more constant than if the control were applied strictly against a pressure setpoint.

In FIG. 3 a flow chart is provided of the computations required in the firing rate control means 42 to accomplish the present invention. A desired operating pressure is initially utilized at 50 and has been identified as an input pressure setting in pounds per square inch. This setting has been identified as SETPOINT. SETPOINT 50 is supplied within the microcomputer 40, memory 41, and firing rate control means 42 to a first calculation identified as calculation "A" at 51. Calculation "A" is expressed as $$\left[\frac{-8523.83}{\mathrm{LN}(\mathrm{PRESSURE\ SETPOINT} + 14.7) - 15.427}\right] - 459.67;$$

Calculation "A" utilizes known thermal dynamic information to convert the pressure in pounds per square inch to a temperature that has been identified as TSET 52. The formula for this computation, as was stated is well known, but is set out in FIG. 3.

The TSET 52 temperature is combined at a calculation "B" 53 with SETPOINT 50 and a further function at 54 that is an empirically developed bandwidth of temperatures for proper control of boilers. Calculation "B" is expressed as 2 (PRESSURE SETPOINT-$-e^x+14.7$) where $x=-8523.83/(TSET-\frac{1}{2}TBAND+459.67)+15.4267$. This temperature bandwidth can be selected based upon the known characteristics of the boiler to be controlled. The bandwidth of temperatures at 54 has been identified as ½ TBAND 54. The combination of the SETPOINT 50, TSET 52, and ½ TBAND 54 in a calculation "B" provides for the generation at an output of block 53 at 55 as a pressure bandwidth that has been identified as PBAND'. This pressure band provides a control according to the calculation "B" formula set forth in FIG. 3. This calculation allows for a pressure band to be established that is both a function of the initial setpoint pressure and the temperature calculation to convert the pressure setpoint to a temperature setpoint. The pressure band PBAND' at 55 provides a better control than if the control had been operated solely against a pressure setpoint.

The flow chart of FIG. 3 is completed by the addition of the block 56 which takes into consideration the thermal mass (TM) of the particular type of boiler being operated. Four general classes of boilers have been identified, and the function at block 56 is inputted at the input-output means 36 so that the system can modify PBAND' for the particular class of boilers being controlled. The output of block 56 is PBAND 57 which is the actual control pressure band that is (supplied on conductor 43 at FIG. 2 to the comparator and control 44. This pressure band PBAND 57 allows for comparison to the actual operating pressure sensed at 26 and provides a much tighter and more accurate control of a boiler than would be available with prior art type of devices disclosed in connected with FIG. 1.

Very simply stated, the present invention recognizes that control of a boiler in a temperature range is more accurate than control against a pressure range. The invention utilizes a microcomputer based boiler control system 35 utilizing a microcomputer 40, a memory 41, and a firing rate control means 42 to convert a pressure setting into a temperature range which is then in turn converted back into a pressure band for more accurate and better control of the boiler. A highly simplified form of the invention has been disclosed in order to convey the concept of the invention. The invention could be modified in numerous ways by one skilled in the art, and the scope of the present invention shall be deemed controlled solely by the scope of the appended claims.

The embodiments of an invention in which an exclusive property or right is claimed are defined as follows:

1. A boiler control system having a firing rate control function, including: microcomputer means including memory means, and further including input-output means; said input-output means connected to said microcomputer means and said memory means to provide said microcomputer means and said memory means with a plurality of control parameters for a fuel burner and a boiler which are adapted to be controlled by said boiler control system; firing rate control means connected to said microcomputer means and said memory means with said firing rate control means establishing a pressure control band which is a function of a selected setpoint control pressure and a selected temperature band; said firing rate control means converting said setpoint control pressure into a temperature setpoint; said firing rate control means further converting said selected temperature band and said temperature setpoint into a pressure control band; means to measure a pressure in said boiler; comparator means responsive to said pressure control band and a said measured pressure from said boiler to which said system is adapted to be connected; and said comparator means having output means connected to said fuel burner for said boiler to control said fuel burner to in turn control said pressure in said boiler.

2. A boiler control system as claimed in claim 1 wherein said selected temperature band (TBAND) is an empirically selected band of temperatures to provide stable operation of said fuel burner for said boiler.

3. A boiler control system as claimed in claim 2 wherein said temperature setpoint (TSET) is a computed temperature expressed as:

$$\left[\frac{-8523.83}{\mathrm{LN(PRESSURE\ SETPOINT}+14.7)-15.427}\right]-459.67.$$

4. A boiler control system as claimed in claim 3 wherein a modified form of said pressure control band is computed as a function of said temperature band, said setpoint pressure, and said temperature setpoint.

5. A boiler control system as claimed in claim 4 wherein said modified pressure control band (PBAND') is expressed as:

$2(PRESSURE\ SETPOINT-e^x+14.7)$ where $x\times=-8523.83/(TSET-\frac{1}{2}TBAND+459.67)+15.4267$.

6. A boiler control system as claimed in claim 1 wherein said firing rate control means further adjusts said modified pressure control band as a function of a thermal mass of said boiler to be controlled.

* * * * *